US008403712B2

(12) United States Patent
Bazayev et al.

(10) Patent No.: US 8,403,712 B2
(45) Date of Patent: Mar. 26, 2013

(54) BARBED CONTACT MEMBER FOR AN ELECTRICAL RECEPTACLE

(75) Inventors: Edward Bazayev, Kew Gardens, NY (US); Michael John Marchetti, Bridgeport, CT (US); Thomas Louis Scanzillo, Monroe, CT (US)

(73) Assignee: Hubbell Incorporated, Shelton, CT (US)

( * ) Notice: Subject to any disclaimer, the term of this patent is extended or adjusted under 35 U.S.C. 154(b) by 13 days.

(21) Appl. No.: 12/926,341

(22) Filed: Nov. 10, 2010

(65) Prior Publication Data

US 2012/0115372 A1 May 10, 2012

(51) Int. Cl.
*H01R 13/40* (2006.01)

(52) U.S. Cl. ..... 439/733.1

(58) Field of Classification Search ..... 439/733.1, 439/751, 752.5, 567
See application file for complete search history.

(56) References Cited

U.S. PATENT DOCUMENTS

| | | | | |
|---|---|---|---|---|
| 3,778,749 | A | 12/1973 | Kapell | |
| 5,154,634 | A | 10/1992 | Brown | |
| 5,228,870 | A | 7/1993 | Gorenc | |
| 5,393,247 | A * | 2/1995 | DiOrazio et al. | 439/567 |
| 5,441,313 | A | 8/1995 | Kalahasthy | |
| 5,632,649 | A | 5/1997 | Spangler | |
| 5,893,590 | A | 4/1999 | Klinger | |
| 6,080,012 | A | 6/2000 | Zhu | |
| 6,161,804 | A | 12/2000 | Paske | |
| 6,171,126 | B1 * | 1/2001 | Wu et al. | 439/224 |
| 6,398,594 | B1 | 6/2002 | Bonilla | |
| 6,454,575 | B1 | 9/2002 | Jones | |
| 6,581,311 | B1 | 6/2003 | Davey | |
| 6,672,901 | B2 | 1/2004 | Schulz | |
| 7,083,467 | B2 | 8/2006 | Kidman | |
| 7,510,412 | B1 | 3/2009 | Valentin | |
| 7,749,019 | B2 | 7/2010 | Valentin | |
| 2009/0227148 | A1 | 9/2009 | Yoshida | |

* cited by examiner

*Primary Examiner* — Javaid Nasri
(74) *Attorney, Agent, or Firm* — Marcus R. Mickney; Mark S. Bicks; Alfred N. Goodman

(57) ABSTRACT

A contact member for an electrical receptacle includes a connecting member having first and second ends. A first contact is connected to the first end of the connecting member and a second contact is connected to the second end of the connecting member. A first tab is connected to the first contact and is received by a base of the electrical receptacle. A second tab is connected to the second contact and is received by the base of the electrical receptacle. A plurality of barbs are disposed on the first and second tabs to securely retain the contact member in the electrical receptacle.

20 Claims, 5 Drawing Sheets

BARBED CONTACT MEMBER FOR AN ELECTRICAL RECEPTACLE

FIELD OF THE INVENTION

The present invention relates to a contact member for an electrical receptacle having a barbed tab to securely retain the contact member in a base of an electrical receptacle. By securely retaining the contact member in the base of the electrical receptacle, stress is substantially prevented or resisted from being imparted to other components of the electrical receptacle when removing a plug.

BACKGROUND OF THE INVENTION

Electrical receptacles are typically installed in new commercial and residential construction projects in large quantities. Contact members disposed in the electrical receptacle receive blades of a plug inserted in the receptacle to transfer electrical power from the power distribution line to the load connected to the plug.

When an inserted plug is removed from engagement with the contact members disposed in the electrical receptacle, the contact members move in the withdrawal direction of the plug. This movement of the contact members imparts stress to other components disposed in the electrical receptacle, such as a printed circuit board, tamper resistant shutter assemblies, wires and other electrical components, thereby possibly damaging such components. The possibility of damage to these components is increased when the plug withdrawal is done quickly and abusively. Accordingly, a need exists for an improved contact member that is substantially prevented from movement when withdrawing a plug from the receptacle.

SUMMARY OF THE INVENTION

Accordingly, it is a primary objective of the present invention to provide an improved contact member for an electrical receptacle.

A further objective of the present invention is to provide a contact member having a barbed tab received by a base of the electrical receptacle, thereby substantially preventing movement of the contact member when withdrawing a plug therefrom.

The foregoing objectives are basically attained by a contact member for an electrical receptacle including a connecting member having first and second ends. A first contact is connected to the first end of the connecting member and a second contact is connected to the second end of the connecting member. A first tab is connected to the first contact and is received by a base of the electrical receptacle. A second tab is connected to the second contact and is received by the base of the electrical receptacle. A plurality of barbs are disposed on the first and second tabs to securely retain the contact member in the electrical receptacle.

The foregoing objectives may also be attained by an electrical receptacle including a base having first and second slots disposed therein. A first contact member has first and second barbed tab members received by the first and second slots in the base. The first contact member is adapted to receive a plug. An electrical component is positioned above the first contact member. The first and second barbed tab members prevent movement of the first contact member when a plug is withdrawn therefrom such that stress is not imparted to the electrical component.

As used in this application, the terms "front," "rear," "upper," "lower," "upwardly," "downwardly," and other relative orientational descriptors are intended to facilitate the description of the electrical receptacle, and are not intended to limit the structure of the electrical receptacle assembly to any particular position or orientation.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

Throughout the drawings, like reference numerals will be understood to refer to like parts, components and structures.

DETAILED DESCRIPTION OF EXEMPLARY EMBODIMENTS

Figure 1:
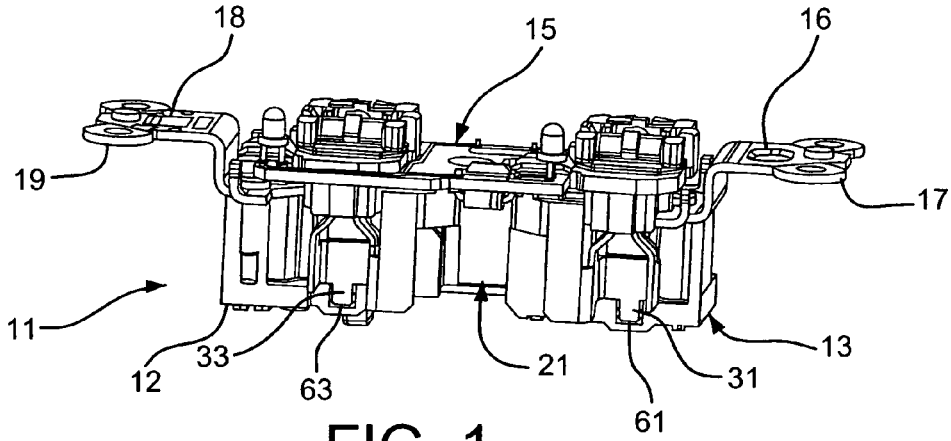
FIG. 1 is a perspective view of a contact member disposed in a base of an electrical receptacle according to an exemplary embodiment of the present invention.

As shown in FIGS. 1-7, the present invention relates to a contact member 21 for an electrical receptacle 11. The contact member 21 has a connecting member 23 having a first end 24 and a second end 26. A first contact 25 is connected to the first end 24 of the connecting member 23 and a second contact 27 is connected to the second end 26 of the connecting member. A first tab 31 is connected to the first contact 25 and is received by a base 13 of the electrical receptacle 11. A second tab 33 is connected to the second contact 27 and is received by the base 13 of the electrical receptacle 11. The first tab 31 has a first plurality of barbs 35, and the second tab 33 has a second plurality of barbs 37 to securely retain the contact member in the electrical receptacle 11.

The electrical receptacle 11 includes a cover (not shown) adapted to be connected to the base 13. The cover has openings therein for receiving prongs of an electrical plug (not shown). The cover has downwardly extending posts that are receivable by pockets 14 of the base 13, thereby creating a snap fit to secure the cover to the base. A cover connected to a base of an electrical receptacle is shown in U.S. Pat. No. 7,510,412, which issued Mar. 31, 2009, and is hereby incorporated by reference in its entirety.

A ground strap 15 is connected to the base 13 and has first and second mounting ears 17 and 19 disposed at opposite ends of the ground strap. Each mounting ear 17 and 19 has an opening 16 and 18 to receive a fastener to secure the electrical receptacle 11 to an electrical box (not shown). The ground strap 15 may be disposed between the base 13 and the cover, or may wrap around the bottom surface 12 of the base.

Figure 3:
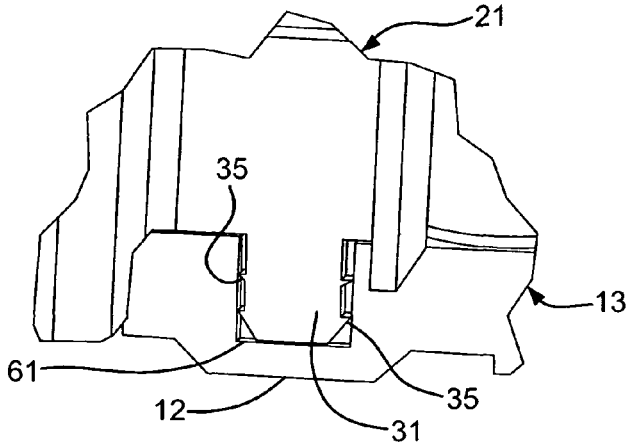
FIG. 3 is an enlarged, partial side elevational view of a slot in the base of the electrical receptacle receiving a barbed tab of the contact member of FIG. 1.
Figure 5:
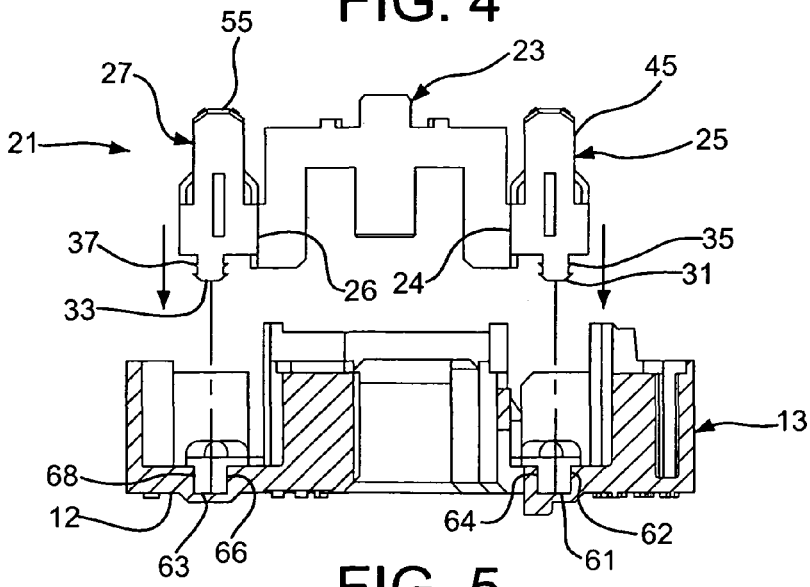
FIG. 5 is an exploded side elevational view in partial cross section of the electrical receptacle of FIG. 4 prior to receiving the contact member taken along line 5-5 of FIG. 4.

As noted above, the contact member 21 has a connecting member 23 having first and second ends 24 and 26 to which the first and second contacts 25 and 27 are connected, as shown in FIG. 5. The first contact 25 has first, second and third flexible arms 41, 43 and 45 forming a gripping structure to receive and engage a prong of an inserted plug. Although the gripping structure is shown having three flexible arms, any suitable number of flexible arms may be used, such as two. The first tab 31 is an integral and unitary part of the one piece contact member 21 and extends from the remainder of the first contact 25 in a direction substantially opposite to the direction in which the flexible arms 41, 43 and 45 extend. Preferably, the first tab 31 extends downwardly from the second flexible arm 45. The first plurality of barbs 35 extend outwardly from opposite sides of the first tab 31. Preferably, the barbs 35 extend upwardly toward the flexible arms, as shown in FIG. 3, to prevent removal of the contact member 21 from the base 13.

Figure 6:
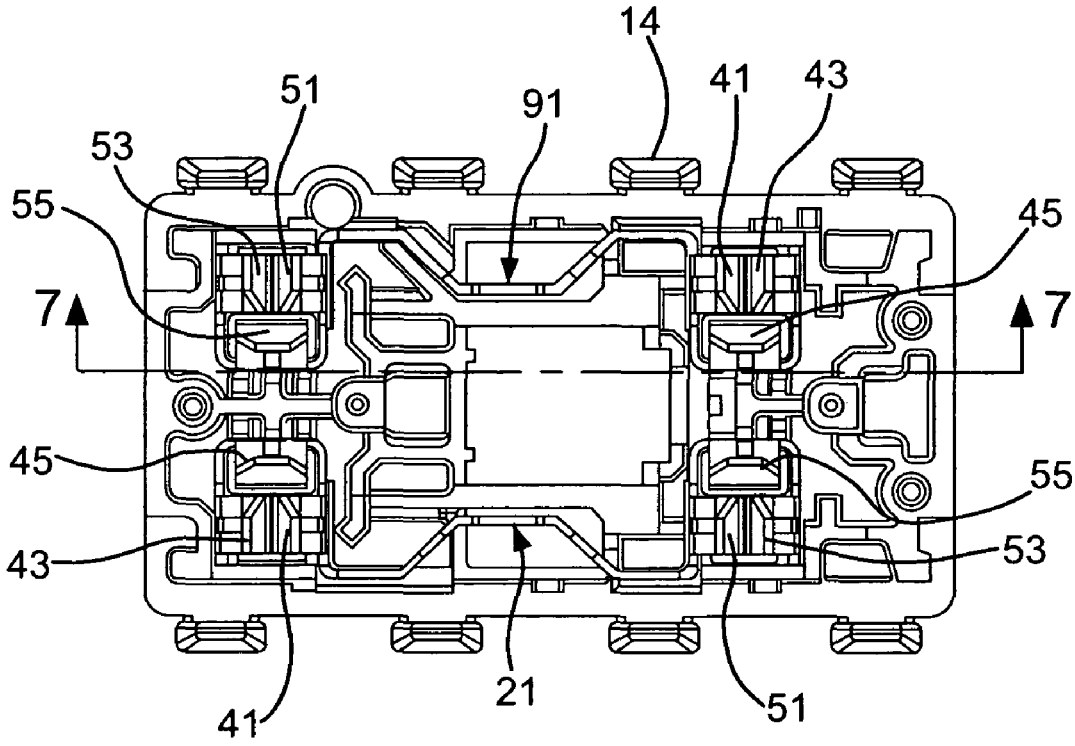
FIG. 6 is a top plan view of the electrical receptacle of FIG. 1 without the cover.
Figure 7:
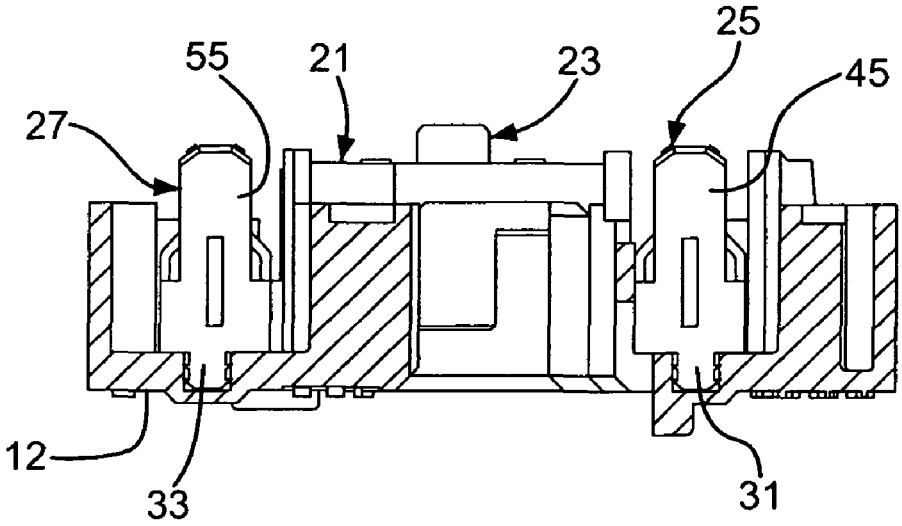
FIG. 7 is a side elevational view in partial cross section of the electrical receptacle taken along line 7-7 of FIG. 6.

The second contact 27 has first, second and third flexible arms 51, 53 and 55, as shown in FIG. 6, forming a gripping structure to receive a prong of an inserted plug. Although the gripping structure is shown having three flexible arms, any suitable number of flexible arms may be used, such as two. The second tab 33 is an integral and unitary part of the one piece contact member 21 and extends from the remainder of the second contact 27 in a direction substantially opposite to the direction in which the flexible arms 51, 53 and 55 extend. Preferably, the second tab 33 extends downwardly from the second flexible arm 55. The second plurality of barbs 37 extend outwardly from opposite sides of the second tab 33. Preferably, the barbs 37 extend upwardly toward the flexible arms, as shown in FIG. 3, to prevent removal of the contact member 21 from the base 13.

First and second slots 61 and 63 are formed in the base 13 of the electrical receptacle 11 to receive the first and second tabs 31 and 33 of the first contact member 21, as shown in FIGS. 1 and 6. The first plurality of tabs 35 engage opposite sides 62 and 64 of the first slot 61 and the second plurality of tabs 37 engage opposite sides 66 and 68 of the second slot 63. The plurality of barbs engage the opposite sides of the first and second slots to resist upward movement of the contact member 21 when a plug is removed from mating engagement with the gripping structure.

A printed circuit board 71 is disposed between the ground strap 19 and the cover of the receptacle 11. A plurality of status indicators 73, such as LEDs, may be connected to the circuit board 71 to indicate the status of the receptacle 11.

A second contact member 91 may be disposed in the base 13 of the electrical receptacle 11 in mirror image to contact member 21, as shown in FIG. 6. The second contact member 91 is substantially identical in structure and operation to the first contact member 21. The reference numbers for the second contact member 91 are the same as those used for the first contact member 21.

A plurality of tamper resistant shutter assemblies 81 can be disposed between the circuit board 71 and the cover of the receptacle 11. The tamper resistant shutter assemblies 81 resist insertion of objects other than the intended plug into the receptacle and completing an electrical circuit with the contact members 21 and 91. A tamper resistant shutter assembly is shown in U.S. Pat. No. 7,510,412, which issued Mar. 31, 2009, and is hereby incorporated by reference in its entirety.

Preferably, each contact member 21 and 91 is unitarily formed as a single piece and made of a metal, such as brass. Preferably, the base 13 is made of a plastic.

Assembly and Disassembly

Figure 2:
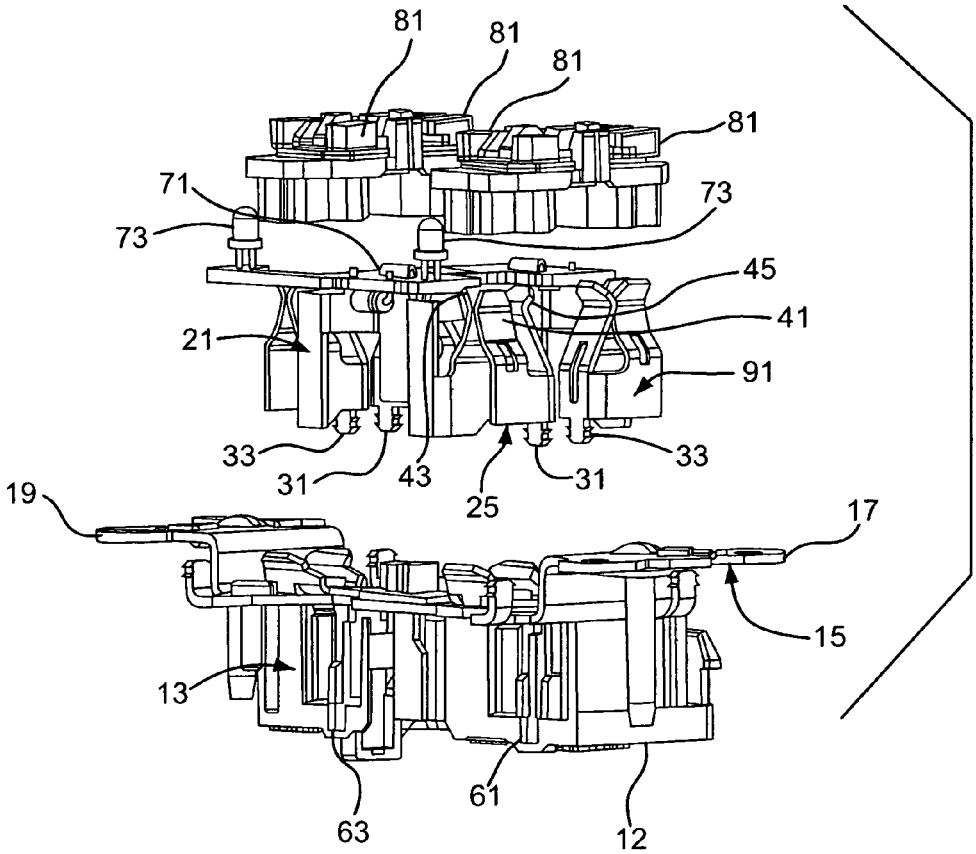
FIG. 2 is an exploded perspective view of the electrical receptacle of FIG. 1.
Figure 4:
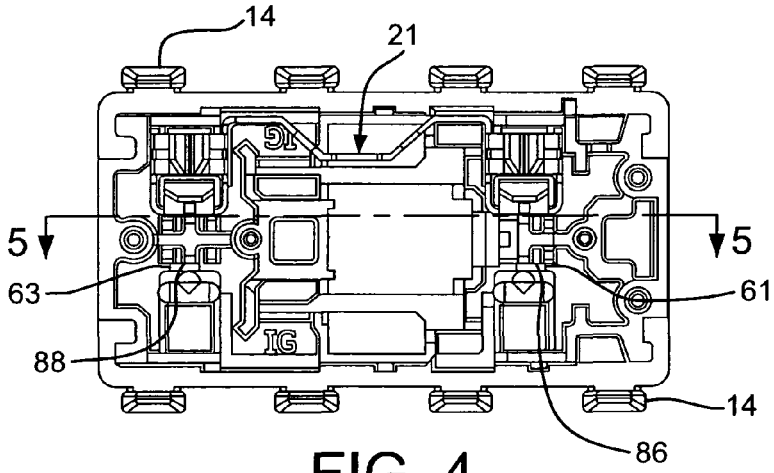
FIG. 4 is a top plan view of an electrical receptacle in which one contact member is disposed in the base but with the cover removed.

The contact member 21 according to an exemplary embodiment of the present invention is shown disposed in the base 13 of the electrical receptacle 11 in FIGS. 1, 3, 6 and 7, and spaced from the electrical receptacle in FIGS. 2, 4 and 5.

The first contact member 21 is inserted in the receptacle such that the barbed tabs 31 and 33 are received by the slots 61 and 63 of the base. As shown in FIG. 3, the barbs 35 extend upwardly away from the bottom surface 12 of the base 13. A second contact member 91 is similarly disposed in the base 13 of the receptacle 11, as shown in FIG. 6. A printed circuit board 71 can then disposed over the ground strap 19. Tamper resistant shutter assemblies 81 can then be disposed above the circuit board 71, as shown in FIG. 2. The downwardly extending posts of the cover are snapped into the pockets 14 of the base 13 to enclose the first and second contact members 21 and 91 within the receptacle 11.

Prongs of a plug are inserted through openings in the cover and through the shutter assemblies 81 to mechanically and electrically engage the flexible arms 41, 43, 45, 51, 53 and 55. When unplugging the plug from the receptacle 11, the barbs 35 and 37 of the first and second tabs 31 and 33 engage the side walls 62, 64, 66 and 68 of the slots 61 and 63, thereby substantially preventing upward movement of the contact members with the plug as the plug is being removed. By substantially preventing and resisting this upward movement of the contact members, undue stress is prevented from being imparted to any components disposed between the contact members and the cover, such as the circuit board 71 and the tamper resistant shutter assemblies 81, thereby prolonging the life of the electrical receptacle 11.

Figure 8:
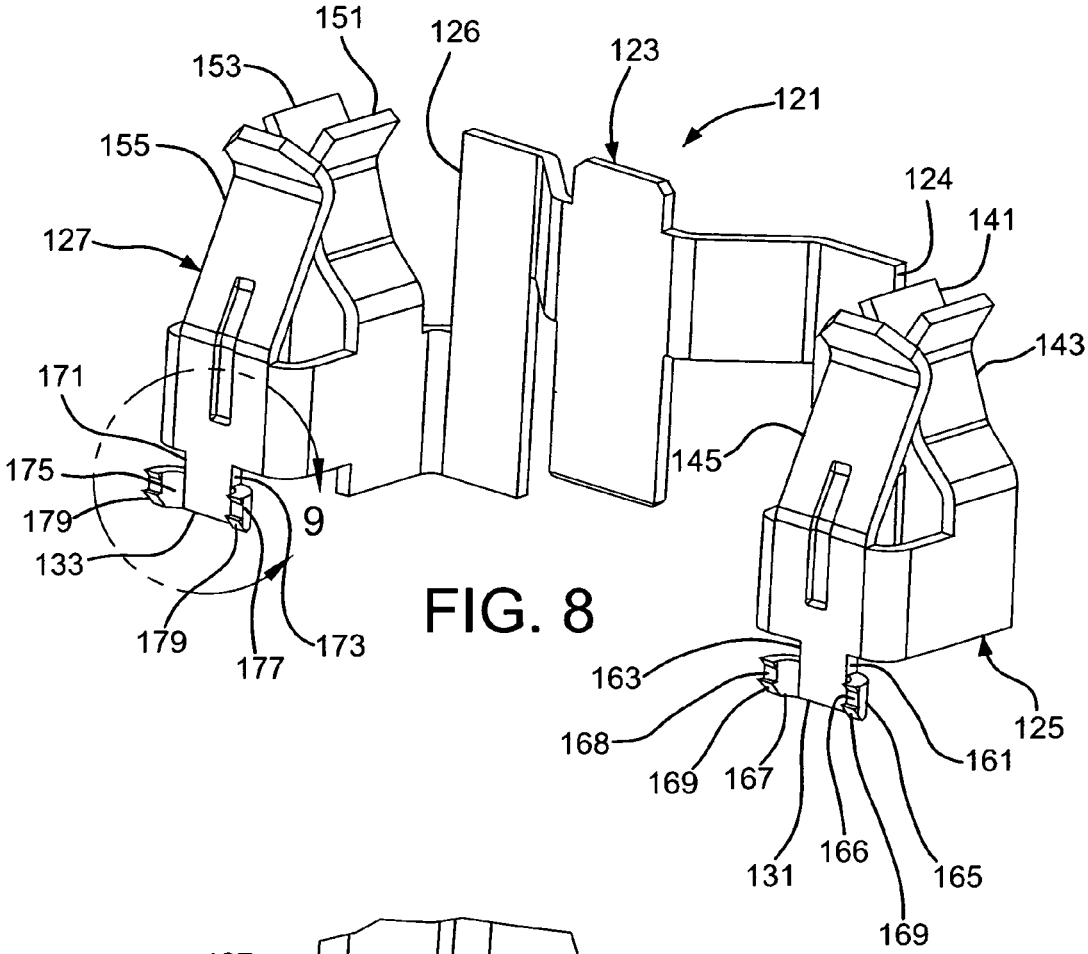
FIG. 8 is a perspective view of a contact member according to a second exemplary embodiment of the present invention.
Figure 9:
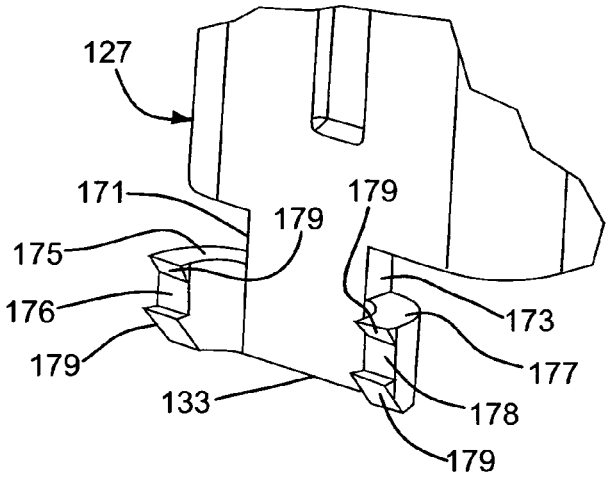
FIG. 9 is an enlarged perspective view of the contact barbs taken from area 9 of FIG. 8.

A second exemplary embodiment of a contact member of the present invention is shown in FIGS. 8 and 9. The contact member 121 has a connecting member 123 having first and second ends 124 and 126 to which the first and second contacts 125 and 127 are connected, as shown in FIG. 8. The first contact 125 has first, second and third flexible arms 141, 143 and 145 forming a gripping structure to receive and engage a prong of an inserted plug. Although the gripping structure is shown having three flexible arms, any suitable number of flexible arms may be used, such as two. The first tab 131 is an integral and unitary part of the one piece contact member 121 and extends from the remainder of the first contact 125 in a direction substantially opposite to the direction in which the flexible arms 141, 143 and 145 extend. Preferably, the first tab 131 extends downwardly from the second flexible arm 145.

The first tab 131 has first and second opposite sides 161 and 163 and first and second arms 165 and 167 extending outwardly therefrom. A plurality of barbs 169 extend outwardly from end surfaces 166 and 168 of the first and second arms 165 and 167, respectively. Preferably, the barbs 169 extend upwardly toward the flexible arms, as shown in FIGS. 8 and 9, to prevent removal of the contact member 121 from the base 13. The barbs 169 preferably extend along an entirety of the width of the end surfaces 166 and 168.

The second contact 127 has first, second and third flexible arms 151, 153 and 155, as shown in FIG. 8, forming a gripping structure to receive a prong of an inserted plug. Although the gripping structure is shown having three flexible arms, any suitable number of flexible arms may be used, such as two. The second tab 133 is an integral and unitary part of the one piece contact member 121 and extends from the remainder of the second contact 127 in a direction substantially opposite to the direction in which the flexible arms 151, 153 and 155 extend. Preferably, the second tab 133 extends downwardly from the second flexible arm 155. The second plurality of barbs 137 extend outwardly from opposite sides of the second tab 33. Preferably, the barbs 37 extend upwardly toward the flexible arms, as shown in FIG. 3, to prevent removal of the contact member 21 from the base 13.

The second tab 133 has first and second opposite sides 171 and 173 and first and second arms 175 and 177 extending outwardly therefrom. A plurality of barbs 179 extend outwardly from end surfaces 176 and 178 of the first and second arms 175 and 177, respectively. Preferably, the barbs 179 extend upwardly toward the flexible arms, as shown in FIGS. 8 and 9, to prevent removal of the contact member 121 from the base 13. The barbs 179 preferably extend along an entirety of the width of the end surfaces 176 and 178. Preferably, the barbs 169 and 179 are integrally formed as a unitary member with the first and second tabs.

The contact member 121 in accordance with the second exemplary embodiment operates in a substantially similar manner to the contact member 21 of the first exemplary embodiment. When unplugging the plug from the receptacle 11, the barbs 169 and 179 of the first and second tabs 131 and 133 engage the rear walls 86 and 88 of the slots 61 and 63 (FIG. 4), thereby substantially preventing upward movement of the contact members 121 with the plug as the plug is being removed. By substantially preventing and resisting this upward movement of the contact members 121, undue stress is prevented from being imparted to any components disposed between the contact members and the cover, such as the circuit board 71 and the tamper resistant shutter assemblies 81, thereby prolonging the life of the electrical receptacle 11.

Figure 10:
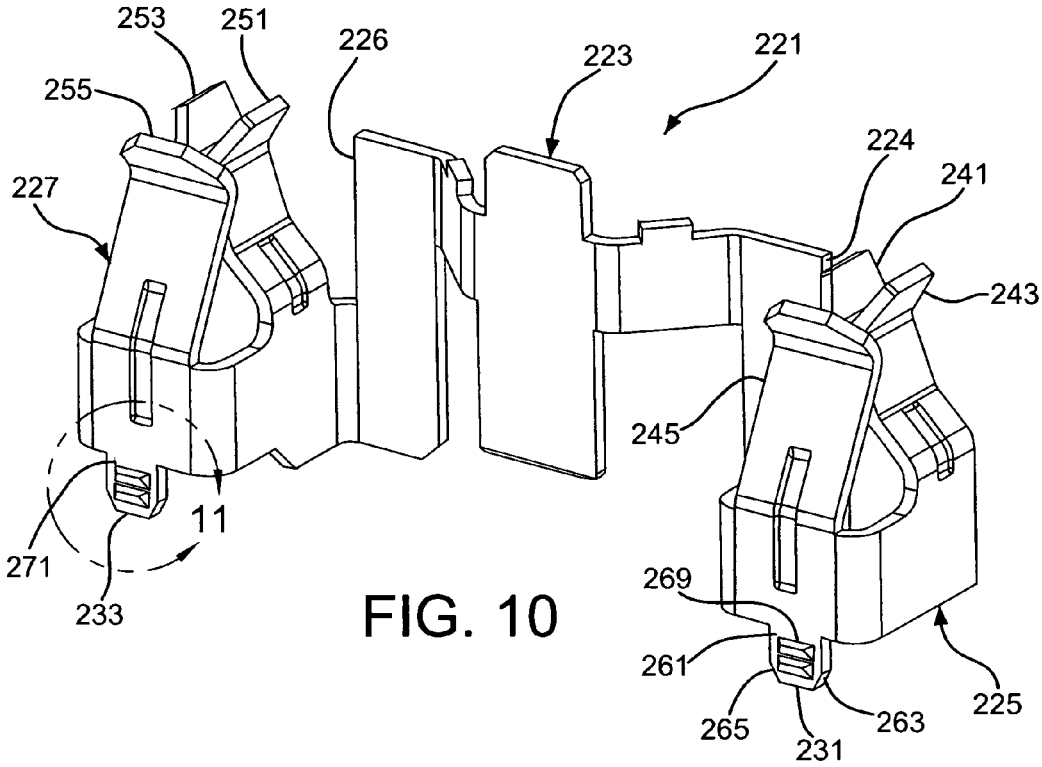
FIG. 10 is a perspective view of a contact member according to a third exemplary embodiment of the present invention.
Figure 11:
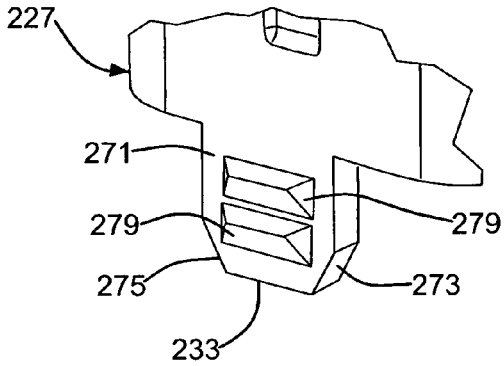
FIG. 11 is an enlarged perspective view of the contact barbs taken from area 11 of FIG. 10.

A third exemplary embodiment of a contact member of the present invention is shown in FIGS. 10 and 11. The contact member 221 has a connecting member 223 having first and second ends 224 and 226 to which the first and second contacts 225 and 227 are connected, as shown in FIG. 10. The first contact 225 has first, second and third flexible arms 241, 243 and 245 forming a gripping structure to receive and engage a prong of an inserted plug. Although the gripping structure is shown having three flexible arms, any suitable number of flexible arms may be used, such as two. The first tab 231 is an integral and unitary part of the one piece contact member 221 and extends from the remainder of the first contact 225 in a direction substantially opposite to the direction in which the flexible arms 241, 243 and 245 extend. Preferably, the first tab 231 extends downwardly from the second flexible arm 245. Opposite sides 263 and 265 of the first tab 231 taper inwardly at a free end of the first tab.

The first tab 231 has a front surface 261. A plurality of barbs 269 extend outwardly from the front surface 261. Preferably, the barbs 269 extend upwardly toward the flexible arms, as shown in FIG. 10, to prevent removal of the contact member 221 from the base 13. The barbs 269 preferably extend along a majority of the width of the front surface 261. A plurality of barbs can also be disposed on a rear surface of the first tab opposite the front surface 261.

The second contact 227 has first, second and third flexible arms 251, 253 and 255, as shown in FIG. 10, forming a gripping structure to receive a prong of an inserted plug. Although the gripping structure is shown having three flexible arms, any suitable number of flexible arms may be used, such as two. The second tab 233 is an integral and unitary part of the one piece contact member 221 and extends from the remainder of the second contact 227 in a direction substantially opposite to the direction in which the flexible arms 251, 253 and 255 extend. Preferably, the second tab 233 extends downwardly from the second flexible arm 255. Opposite sides 273 and 275 of the second tab 233 taper inwardly at a free end of the second tab.

The second tab 233 has a front surface 271. A plurality of barbs 279 extend outwardly from the front surface 271. Preferably, the barbs 279 extend upwardly toward the flexible arms, as shown in FIGS. 10 and 11, to prevent removal of the contact member 221 from the base 13. The barbs 279 preferably extend along a majority of the width of the front surface 271. A plurality of barbs can also be disposed on a rear surface of the second tab opposite the front surface 271. Preferably, the barbs 269 and 279 are integrally formed as a unitary member with the first and second tabs.

The contact member 221 in accordance with the third exemplary embodiment operates in a substantially similar manner to the contact members 21 and 121 of the first and second exemplary embodiments. When unplugging the plug from the receptacle 11, the barbs 269 and 279 of the first and second tabs 231 and 233 engage the rear walls 86 and 88 of the slots 61 and 63 (FIG. 4), thereby substantially preventing upward movement of the contact members 221 with the plug as the plug is being removed. By substantially preventing and resisting this upward movement of the contact members 221, undue stress is prevented from being imparted to any components disposed between the contact members and the cover, such as the circuit board 71 and the tamper resistant shutter assemblies 81, thereby prolonging the life of the electrical receptacle 11.

While one advantageous embodiment has been chosen to illustrate the invention, it will be understood by those skilled in the art that various changes and modifications may be made therein without departing from the scope of the invention as defined in the appended claims.

What is claimed is:

1. A contact member for an electrical receptacle, comprising:

an electrically conductive connecting member having first and second ends;

a first set of electrical contacts mechanically and electrically connected to said first end of said connecting member;

a second set of electrical contacts mechanically and electrically connected to said second end of said connecting member, said second end being opposite said first end and said second set of electrical contacts being spaced from said first set of electrical contacts and arranged to receive first and second electrical members;

a first tab directly connected to and depending from said first set of electrical contacts to be received by a base of the electrical receptacle;

a second tab directly connected to and depending from said second set of electrical contacts to be received by the base of the electrical receptacle; and a plurality of barbs disposed on each of said first and second tabs.

2. The contact member according to claim 1, wherein said plurality of barbs extend outwardly from opposite first and second sides of said first and second tabs.

3. The contact member according to claim 1, wherein said plurality of barbs extend outwardly from a front surface of said first and second tabs.

4. The contact member according to claim 1 wherein said first and second tabs extend downwardly from said first and second sets of contacts.

5. The contact member according to claim 4, wherein said plurality of barbs extend upwardly toward said first and second sets of contacts.

6. The contact member according to claim 1, wherein said contact member is a unitarily formed one-piece member.

7. The contact member according to claim 1, wherein each of said first and second sets of contacts includes a plurality of flexible arms adapted to receive a prong of a plug.

8. The contact member according to claim 7, wherein each of said first and second tabs extends downwardly from one of said flexible arms of said first and second sets of contacts.

9. An electrical receptacle, comprising:

a base having first and second slots disposed therein;

a first electrically conductive contact member having first and second barbed tab members directly connected to and depending therefrom and received in said first and second slots in said base, said first contact member having a first set of electrical contacts spaced apart from a second set of electrical contacts arranged to receive a plug, said first and second barbed tab members being disposed at opposite ends of said first electrically conductive contact members and said first and second sets of electrical contacts being mechanically and electrically connected to said first contact member; and an electrical receptacle component positioned above said first contact member, whereby said first and second barbed tab members resist movement of said first contact member when the plug is withdrawn therefrom such that stress is not imparted to said electrical component.

10. The electrical receptacle according to claim 9, wherein said electrical receptacle component is a printed circuit board.

11. The electrical receptacle according to claim 9, wherein said electrical receptacle component is a tamper resistant shutter assembly.

12. The electrical receptacle according to claim 9, further comprising third and fourth slots disposed in said base; and a second contact member having third and fourth barbed members received in said third and fourth slots in said base, said second contact member having a first set of electrical contacts spaced apart from a second set of electrical contacts adapted to receive the plug;

whereby said third and fourth barbed tab members prevent movement of said second contact member when the plug is withdrawn therefrom such that stress is not imparted to said electrical component.

13. An electrical receptacle, comprising:

a base;

first and second slots disposed in said base; and a first contact member connected to said base, said first contact member including an electrically conductive connecting member having first and second ends;

a first set of electrical contacts mechanically and electrically connected to said first end of said connecting member;

a second set of electrical contacts mechanically and electrically connected to said second end of said connecting member, said second end being opposite said first end and said second set of electrical contacts being spaced from said first set of electrical contacts and arranged to receive first and second electrical members;

a first tab directly connected to and depending from said first set of electrical contacts and received in said first slot;

a second tab directly connected to and depending from said second set of electrical contacts and received in said second slot; and a plurality of barbs disposed on each of said first and second tabs, said plurality of barbs engaging walls of said first and second slots to resist withdrawal of said first contact member when removing a plug from said electrical receptacle.

14. The electrical receptacle according to claim 13, wherein said plurality of barbs extend outwardly from opposite first and second sides of said first and second tabs.

15. The electrical receptacle according to claim 13, wherein said plurality of barbs extend outwardly from a front surface of said first and second tabs.

16. The electrical receptacle according to claim 13, wherein said first and second tabs extend downwardly from said first and second sets of contacts.

17. The electrical receptacle according to claim 16, wherein said plurality of barbs extend upwardly toward said first and second sets of contacts.

18. The electrical receptacle according to claim 13, wherein said first contact member is a unitarily formed one-piece member.

19. The electrical receptacle according to claim 13, further comprising third and fourth slots disposed in said base; and a second contact member having third and fourth barbed members received in said third and fourth slots in said base, said second contact member being adapted to receive the plug;

whereby said third and fourth barbed tab members resist movement of said second contact member when the plug is withdrawn therefrom such that stress is not imparted to said electrical component.

20. The electrical receptacle according to claim 19, wherein said first and second contact members are substantially identical.

* * * * *